US008469661B2

(12) United States Patent
Durocher et al.

(10) Patent No.: US 8,469,661 B2
(45) Date of Patent: Jun. 25, 2013

(54) FABRICATED GAS TURBINE VANE RING

(75) Inventors: Eric Durocher, Vercheres (CA); Lam Nguyen, Brossard (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 1167 days.

(21) Appl. No.: 12/571,802

(22) Filed: Oct. 1, 2009

(65) Prior Publication Data

US 2011/0081240 A1 Apr. 7, 2011

(51) Int. Cl.
*F01D 9/04* (2006.01)

(52) U.S. Cl.
USPC ..... 415/209.2; 415/209.4; 415/210.1

(58) Field of Classification Search
USPC ..... 415/142, 189, 190, 209.2–209.4, 415/210.1; 29/889.21, 889.22
See application file for complete search history.

(56) References Cited

U.S. PATENT DOCUMENTS

| | | | | |
|---|---|---|---|---|
| 2,924,425 | A | 2/1960 | Cutler | |
| 3,004,750 | A | 10/1961 | Broders | |
| 3,166,903 | A * | 1/1965 | White | 60/797 |
| 3,836,282 | A | 9/1974 | Mandelbaum et al. | |
| 4,063,847 | A | 12/1977 | Simmons | |
| 4,452,564 | A * | 6/1984 | Conant et al. | 415/9 |
| 4,832,568 | A | 5/1989 | Roth et al. | |
| 4,934,900 | A | 6/1990 | Schonbach et al. | |
| 5,609,467 | A * | 3/1997 | Lenhart et al. | 415/142 |
| 5,797,725 | A | 8/1998 | Rhodes | |
| 6,206,631 | B1 | 3/2001 | Schilling | |
| 6,394,746 | B1 | 5/2002 | Sathianathan et al. | |
| 6,648,597 | B1 * | 11/2003 | Widrig et al. | 415/200 |
| 7,147,434 | B2 * | 12/2006 | Mons et al. | 415/200 |
| 2008/0078079 | A1 * | 4/2008 | Ellis et al. | 29/889.1 |
| 2010/0272565 | A1 * | 10/2010 | Cheung | 415/208.2 |

* cited by examiner

*Primary Examiner* — Edward Look
*Assistant Examiner* — Jesse Prager
(74) *Attorney, Agent, or Firm* — Norton Rose Canada LLP

(57) ABSTRACT

A static vane ring for gas turbine engines includes a plurality of radial struts extending between and interconnecting outer and inner duct walls which define an annular duct therebetween. A load transfer apparatus is attached to at least one of the outer and inner duct walls to transfer load from vane to ring, and between vanes.

12 Claims, 5 Drawing Sheets

FABRICATED GAS TURBINE VANE RING

TECHNICAL FIELD

The described subject matter relates generally to gas turbine engines and more particularly, to a fabricated static vane ring used in a gas turbine engine.

BACKGROUND OF THE ART

A static vane ring generally includes a plurality of radial struts extending between and interconnecting outer and inner duct walls of the vane ring. In a fabricated sheet metal construction, at least the struts are made of sheet metal and connected by welding to the respective outer and inner duct walls. As schematically illustrated in FIGS. 8 and 9 an end of the strut is conventionally directly welded to the respective outer and inner duct walls of the vane ring. A sharp corner at the junction of the strut and the duct wall may be formed by such welds, which may result in difficulties controlling the fillet radius of the joint between the strut and the duct walls. In addition, static vane rings made from sheet metal may present other engineering challenges such as thin walls which may compromise the vane from an aerodynamic and static structures/lifing standpoint.

Accordingly, there is ever a need to provide improved vane rings for gas turbine engines.

SUMMARY

In accordance with one aspect, the described subject matter provides a static vane ring for a gas turbine engine comprising an annular duct defined between an annular outer duct wall and an annular inner duct wall, each of the outer and inner duct walls defining a gas path surface and a back surface opposed to the gas path surface; a circumferential array of aerodynamic struts extending radially across the duct and interconnecting the outer and inner duct walls; and a load transfer apparatus attached to the back surface of at least one of the outer and inner duct walls, the apparatus having a member surrounding each strut ends extending radially through an opening in said back surface, the members being fixed to both the strut end and the back surface.

In accordance another aspect, the described subject matter provides a fabricated static vane ring for a gas turbine engine comprising an annular gas path duct, the duct defined between an annular outer duct wall of sheet metal and an annular inner duct wall of sheet metal, each of the outer and inner duct walls having a surface facing the duct interior and an opposed back surface; a plurality of hollow struts having an aerodynamic profile, the struts extending radially across the duct and interconnecting the outer and inner duct walls; and an apparatus fixedly mounted to the back surface of at least one of the outer and inner duct walls, the apparatus providing a continuous endless loop around said at least one back surface, the apparatus including portions surrounding ends of the respective struts which extend radially from the at least one back surface, the portions also fixedly mounted to the end portions of the struts.

Further details of these and other aspects of the described subject matter will be apparent from the detailed description and drawings included below.

DESCRIPTION OF THE DRAWINGS

Reference is now made to the accompanying drawings depicting aspects of the described subject matter, in which.

DETAILED DESCRIPTION OF THE PREFERRED EMBODIMENTS

Figure 1:
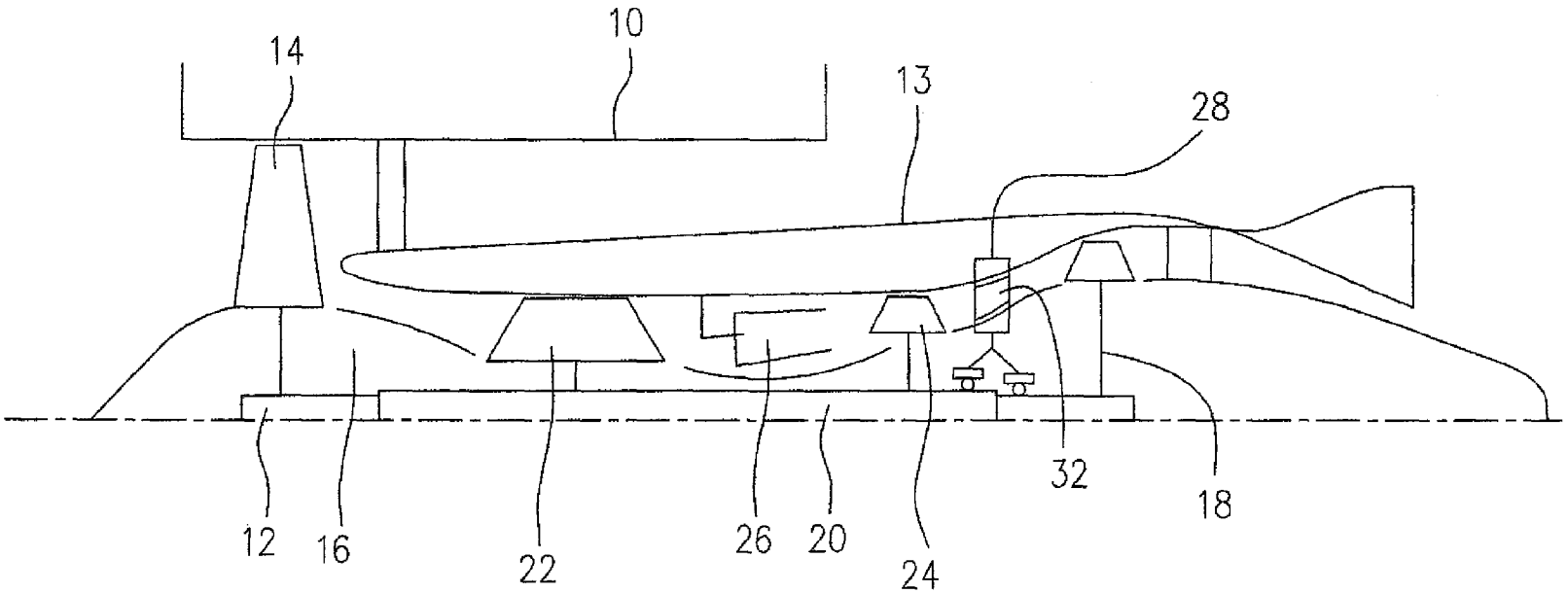
FIG. 1 is a schematic cross-sectional view of a turbofan gas turbine engine according to the present description.

Referring to FIG. 1, a turbofan gas turbine engine includes a fan case 10, a core casing 13, a low pressure spool assembly (not numbered) which includes a fan assembly 14, a low pressure compressor assembly 16 and a low pressure turbine assembly 18 connected by a shaft 12, and a high pressure spool assembly (not numbered) which includes a high pressure compressor assembly 22 and a high pressure turbine assembly 24 connected by a turbine shaft 20. The core casing 13 surrounds the low and high pressure spool assemblies to define a main fluid path therethrough (not numbered). In the main fluid path there is provided a combustor 26 to generate combustion gases in order to power the high and low pressure assemblies 24, 18. A mid turbine frame 28 is disposed between the high and low pressure turbine assemblies 24 and 18 and includes an annular inter turbine duct (ITD) 32 therein for directing hot gases to pass therethrough from the high pressure turbine assembly 24 to the low pressure turbine assembly 18. The terms "axial" and "radial" used for various components below are defined with respect to the main engine axis shown but not numbered in FIG. 1.

Referring to FIGS. 1-5, a static vane ring 30 which is supported within the mid turbine frame 28 defines the annular ITD 32 radially between an annular outer duct wall 34 and an annular inner duct wall 36. Each of the outer and inner duct walls 34, 36 defines a gas path surface 34*a* or 36*a* exposed to the hot gases passing through the ITD 32 and a back surface 34*b* or 36*b* opposed the gas path surface 34*a* or 36*a*. The outer and inner duct walls 34, 36 further define respective opposed axial ends 34*c*, 34*d* and 36*c*, 36*d*. A circumferential array of struts 38 are provided, extending radially across the ITD 32 and interconnecting the outer and inner duct walls 34 and 36.

Each strut 38 has an aerodynamic profile in cross section and may be configured in a hollow configuration according to one embodiment, defined by for example, a shell wall (not numbered).

The shell wall of the strut 38 may be made of sheet metal or other metal components such as casting, etc.

The shell wall of each strut 38 extends outwardly from an opening 40 of the respective outer and inner duct walls 34, 36. A load transfer apparatus (not numbered) is fixedly mounted to at least one back surface 34*b* or 36*b*. The apparatus includes a plurality of load transfer members such as a continuous and endless metal strip plate 42, are attached to the back surface of 34*b* or 36*b* of the respective outer and inner duct walls 34, 36. Each strip plate 42 surrounds an end portion 44 of the shell wall of the strut 38. The strip plate 42 may be welded or brazed to both the end portion 44 of the shell wall of the strut 38 and to the back surface 34*b* or 36*b* of the respective outer and inner duct walls 34, 36. Optionally, the end portion 44 of the shell wall of the strut 38 may radially project from the surrounding strip plate 42, as better shown in FIGS. 4 and 5. Therefore, a constant fillet weld 46 (only shown in FIG. 4) may be applied around the strut 38, and between the projecting end portion 44 of the shell wall of the strut 38 and the continuous and endless strip plate 42.

Figure 6:
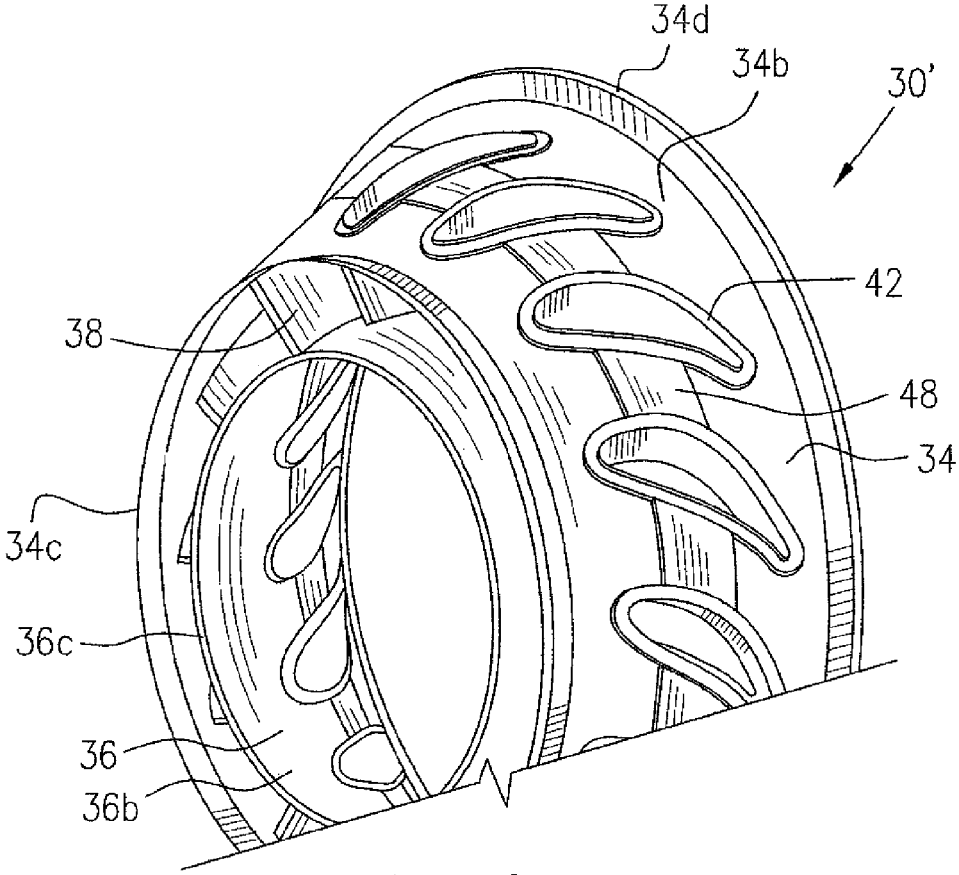
FIG. 6 is a partial perspective view of a fabricated static vane ring used in the gas turbine engine of FIG. 1, according to another embodiment.
Figure 7:
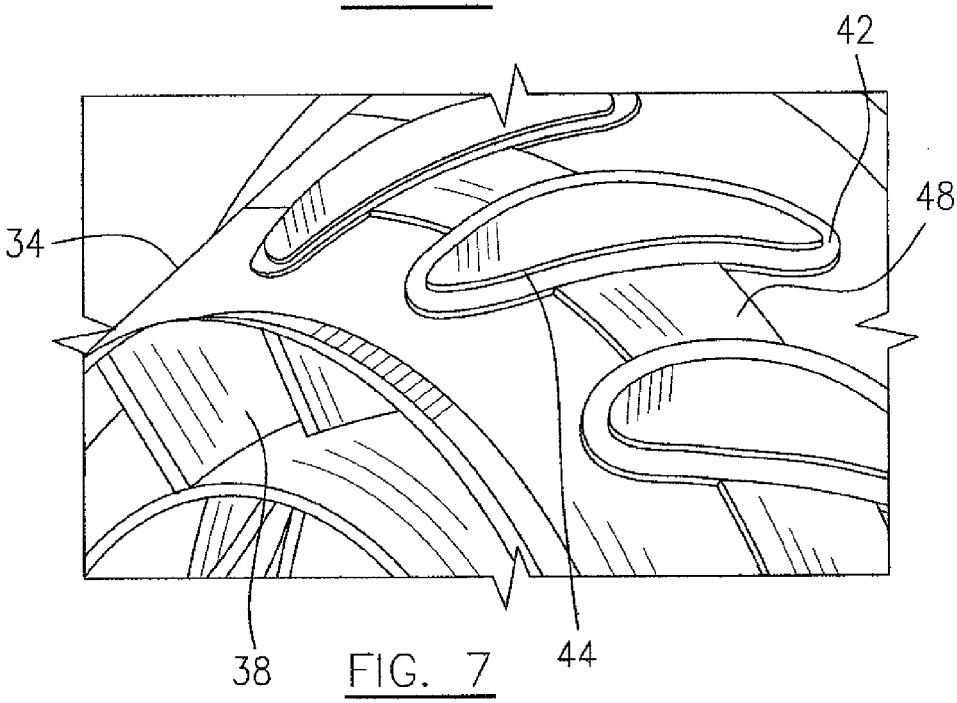
FIG. 7 is a partial perspective view in an enlarged scale, of the static vane ring shown in FIG. 6.

Referring to FIGS. 1, 6 and 7, there is a fabricated static vane ring 30' according to another embodiment. The load transfer apparatus according to this embodiment, provides a continuous endless loop around at least one back surface 34*b* or 36*b*. This apparatus is similar to the apparatus for the vane ring 30 of FIG. 2. Similar components and features which are indicated by similar numeral references will not be repeated herein and described are additional components and features in respect to the embodiment shown in FIG. 2. In addition to the continuous and endless strip plates 42 which are attached to the back surface 34*b* or 36*b* of the respective outer and inner duct walls 34, 36 and surround the respective projecting end portions of the shell wall of the respective struts 38, the static vane ring 30' further includes a plurality of link members 48 such as metal plates attached to the back surface 34*b* or 36*b* of the respective outer and inner duct walls 34, 36. Each link member 48 extends between and interconnects circumferential adjacent strip plates 42.

Each link member 48 may be welded or brazed to the back surface 34*b* or 36*b* of the respective outer and inner duct walls 34, 36 and also welded or brazed to the adjacent strip plates 42, such that the strip plates 42 and the link member 48 in combination forma a thickened circumferential local area of the respective outer and inner duct walls 34, 36.

Each of the link members 48 may be made from a single piece metal plate or from two individual end pieces joining to the duct walls 34 or 36 by welding or brazing. The link members 48 may have an axial dimension with respect to the engine axis shown in FIG. 1, smaller than the axial dimension of the respective struts 38. The link members 48 however, are substantially axially aligned with a strut stacking line 50 (see FIG. 3) of the respective struts 38, thereby reducing joint peak stresses at respective leading and trailing edges, 52*a*, 54*a*, and 52*b*, 54*b* (see FIG. 3).

Figure 2:
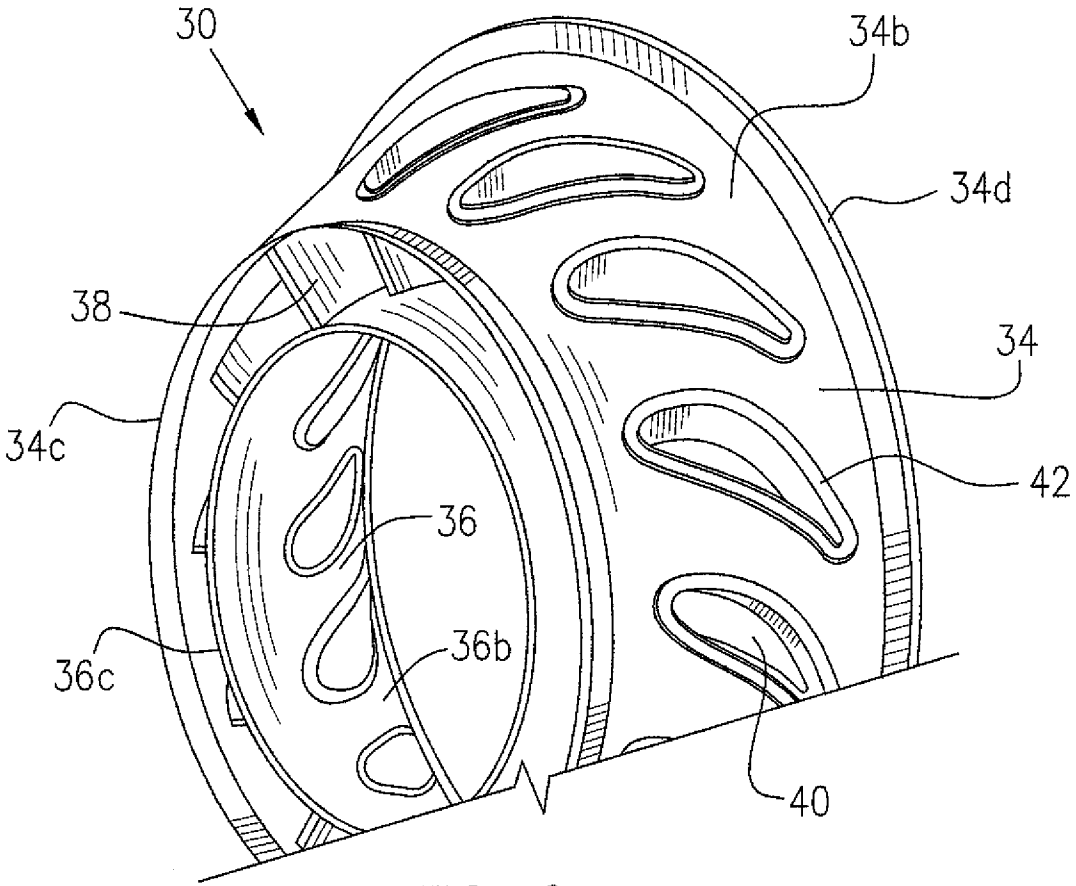
FIG. 2 is a partial perspective view of a fabricated static vane ring used in the gas turbine engine of FIG. 1, according to one embodiment.
Figure 3:
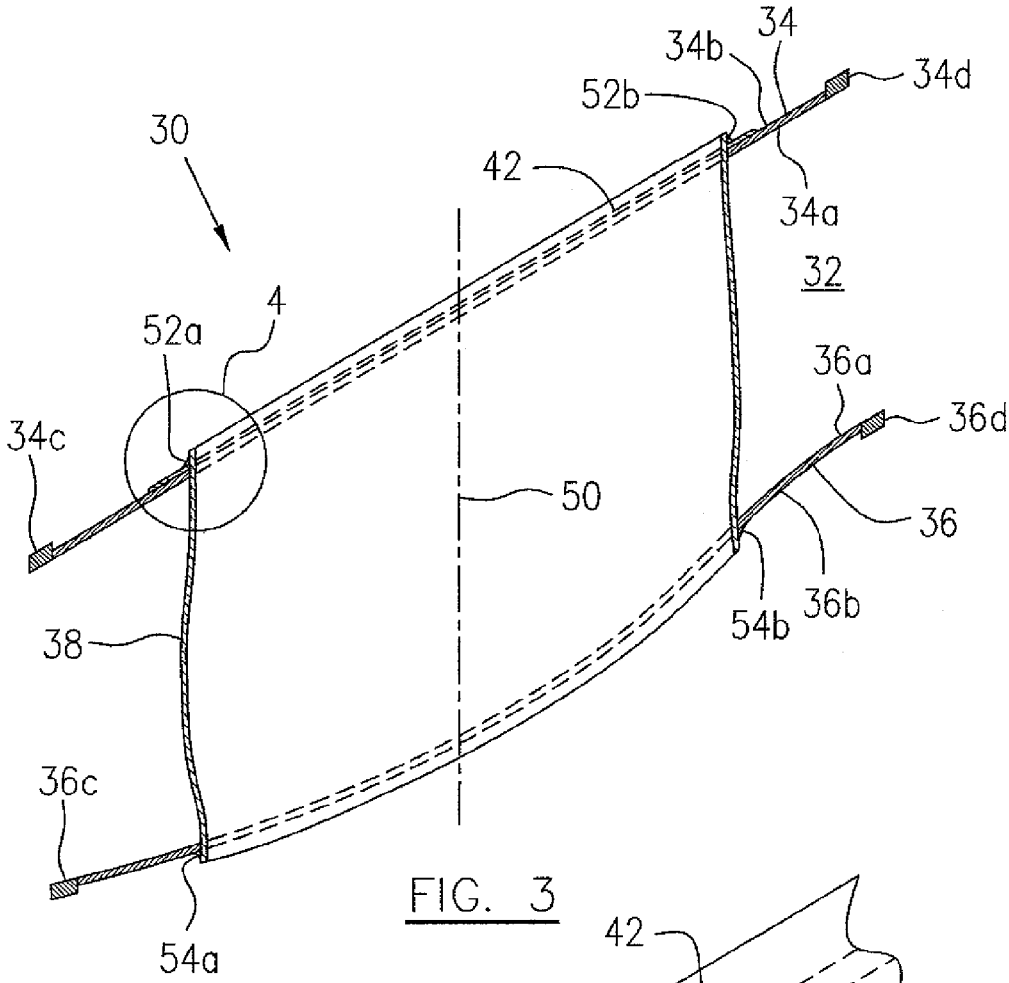
FIG. 3 is a partial cross-sectional view of a fabricated static vane ring of FIG. 2.
Figure 4:
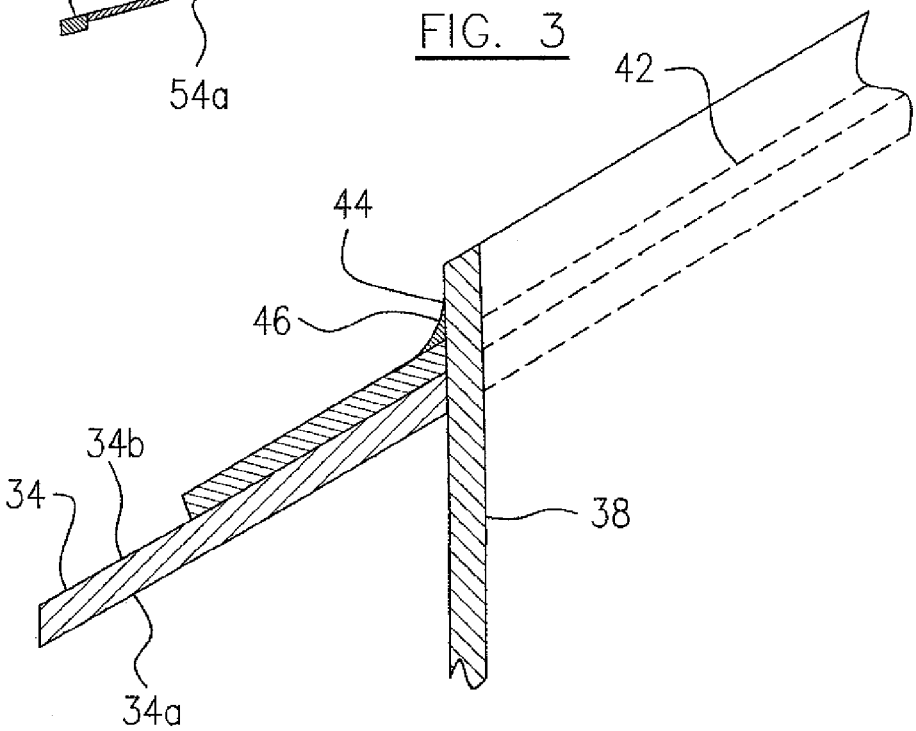
FIG. 4 is a partial cross-sectional view in an enlarged scale, of a circled area 4 of the static vane ring shown in FIG. 3.
Figure 5:
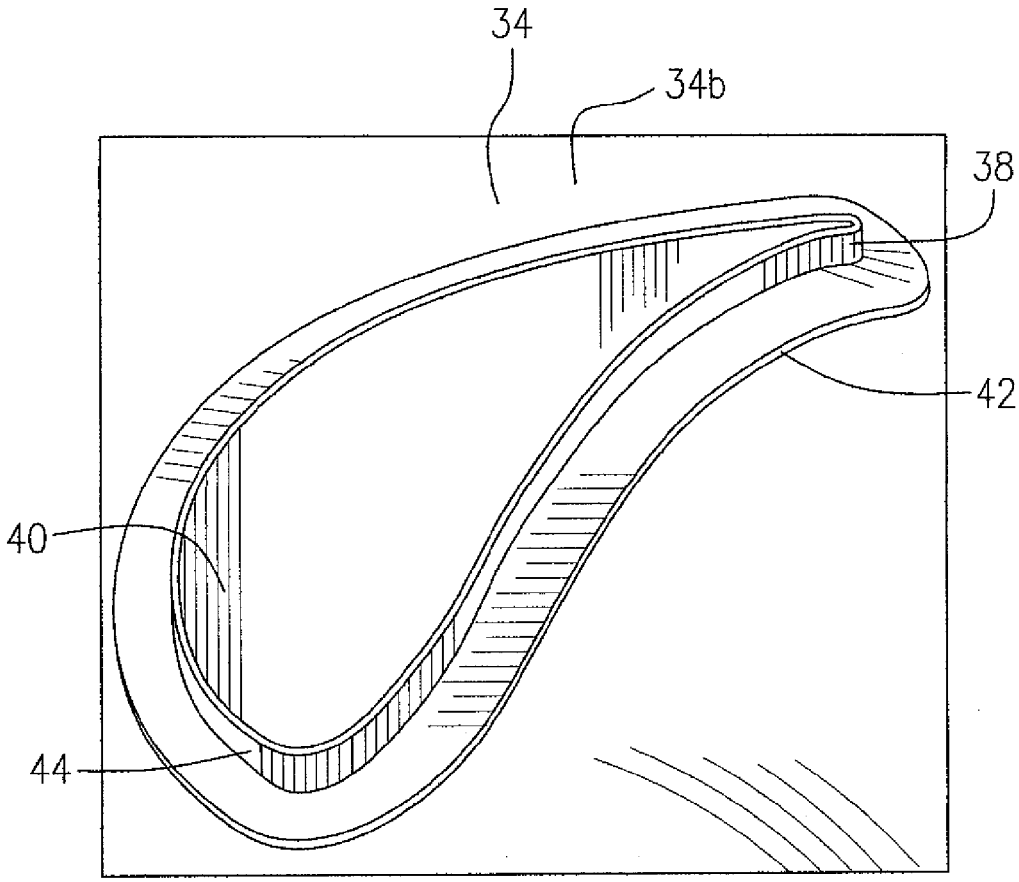
FIG. 5 is a partial perspective view in an enlarged scale, of the static vane ring shown in FIG. 2.
Figure 8:
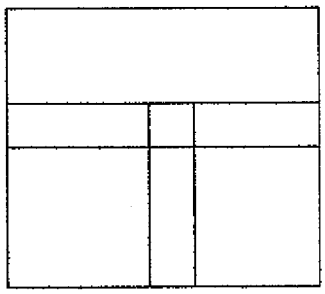
FIG. 8 PRIOR ART
FIG. 8 is a schematic illustration of a prior art junction between a strut and a duct wall of a conventional vane ring before a welding procedure is preformed.
Figure 9:
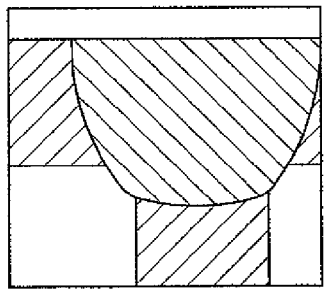
FIG. 9 PRIOR ART
FIG. 9 is a schematic illustration of a prior art junction between a strut and duct wall of a conventional vane ring, showing a sharp corner and uncontrolled fillet radius resulting from a welding procedure.

In both embodiments shown in FIGS. 2 and 6, one or both of the outer and inner duct walls 34, 36 may be made of sheet metal. The axial ends 34*c*, 34*d*, 36*c* and 36*d* of the respective outer and inner duct walls may be fabricated differently from the respective duct walls 34, 36, such as being machined cast or forged rings. The respective outer and inner duct walls 34, 36 may also be fabricated otherwise, such as by casting.

The strip plates 42 and the link members 48 used as load share members, are positioned in specific locations around the duct walls, thereby spreading load evenly to minimize joint peak stresses on the fabricated static vane rings 30, 30', thereby improving part durability and reliability.

The above description is meant to be exemplary only, and one skilled in the art will recognize that changes may be made to the embodiments described without departure from the scope of the described subject matter. For example, a strut having a hollow configuration is described as an embodiment to illustrate the described subject matter. However, the described subject matter is also applicable to struts of other configurations, such as solid struts. The described embodiments illustrate load transfer members attached to both the outer and inner duct walls of the fabricated static vane ring, however, it is understood that these load transfer members could be used with only outer or inner duct walls if it is desired. The strip plates 42 and the link members 48 may be used together, but could also be used separately if it is required. Still other modifications which fall within the scope of the described subject matter will be apparent to those skilled in the art, in light of a review of this disclosure, and such modifications are intended to fall within the appended claims.

The invention claimed is:

1. A static vane ring for a gas turbine engine comprising:

an annular duct defined between an annular outer duct wall and an annular inner duct wall, each of the outer and inner duct walls defining a gas path surface and a back surface opposed to the gas path surface;

a circumferential array of aerodynamic struts extending radially across the duct and interconnecting the outer and inner duct walls; and a load transfer apparatus fixedly mounted to the back surface of at least one of the outer and inner duct walls, the apparatus having a continuous and endless metal strip plate surrounding each strut ends extending radially through an opening in said back surface, a welding or brazing fillet joining the metal strip plate to each of the strut ends and the back surface.

2. The static vane ring as defined in claim 1 wherein the apparatus further comprises a plurality of links extending between and interconnecting circumferentially adjacent said plates.

3. The static vane ring as defined in claim 2 wherein the links are welded or brazed to the back surface of the at least one of the outer and inner duct walls.

4. The static vane ring as defined in claim 2 wherein the links are substantially axially aligned with a strut stacking line of the respective struts.

5. The static vane ring as defined in claim 1 wherein each of the strut ends radially projects from the surrounding member.

6. The static vane ring as defined in claim 1 wherein at least one of the outer and inner duct walls is made of sheet metal.

7. The static vane ring as defined in claim 1 wherein each of the metal strip plates is made of sheet metal.

8. The static vane ring as defined in claim 2 wherein the links are made of sheet metal.

9. A fabricated static vane ring for a gas turbine engine comprising:

an annular gas path duct, the duct defined between an annular outer duct wall of sheet metal and an annular inner duct wall of sheet metal, each of the outer and inner duct walls having a surface facing the duct interior and an opposed back surface;

a plurality of hollow struts having an aerodynamic profile, the struts extending radially across the duct and interconnecting the outer and inner duct walls; and an apparatus fixedly mounted to the back surface of at least one of the outer and inner duct walls, the apparatus providing a continuous endless loop around said at least one back surface, the apparatus including a continuous and endless metal strip plate surrounding each of ends of the respective struts which extend radially from the at least one back surface, a welding or brazing fillet joining the metal strip plate to each of the strut ends and the back surface.

10. The fabricated static vane ring as defined in claim 9 wherein the apparatus comprises a plurality of links attached to the back surface of the respective outer and inner duct walls, each link extending between and interconnecting circumferentially adjacent metal strip plates.

11. The fabricated static vane ring as defined in claim 10 wherein the links are substantially axially aligned with a strut stacking line of the respective struts.

12. The fabricated static vane ring as defined in claim 9 wherein the ends of the struts radially projects from the respective metal strip plate of the apparatus.

* * * * *